United States Patent [19]

Accatino et al.

[11] Patent Number: 5,008,640

[45] Date of Patent: Apr. 16, 1991

[54] DIELECTRIC-LOADED CAVITY RESONATOR

[75] Inventors: Luciano Accatino, Rosta; Giorgio Bertin, Etrouble, both of Italy

[73] Assignee: CSELT - Centro studi e Laboratori Telecommunicazioni S.P.A., Turin, Italy

[21] Appl. No.: 380,978

[22] Filed: Jul. 17, 1989

[30] Foreign Application Priority Data

Jul. 21, 1988 [IT] Italy ..... 67687 A/88

[51] Int. Cl.[5] ..... H01P 7/06; H01P 7/10

[52] U.S. Cl. ..... 333/219.1; 333/227

[58] Field of Search ..... 333/219, 219.1, 227, 333/230, 231, 208, 212, 202, 234, 229

[56] References Cited

U.S. PATENT DOCUMENTS

| | | | |
|---|---|---|---|
| 4,488,124 | 12/1984 | Yoshimura | 333/227 |
| 4,489,293 | 12/1984 | Fiedziuszko | 333/202 |
| 4,630,009 | 12/1986 | Tang | 333/212 X |
| 4,646,038 | 2/1987 | Wanat | 333/229 X |
| 4,661,790 | 4/1987 | Gannon et al. | 333/202 X |

FOREIGN PATENT DOCUMENTS

| | | | |
|---|---|---|---|
| 0067944 | 6/1977 | Japan | 333/208 |

*Primary Examiner*—Eugene R. LaRoche
*Assistant Examiner*—Seung Ham
*Attorney, Agent, or Firm*—Herbert Dubno

[57] ABSTRACT

The cavity resonator is composed of a closed metallic body transversely subdivided into two parts, housing a small dielectric cylinder, which is held in coaxial position inside the cavity by two small quartz plates provided with a centering indentation. Holes are provided in the lateral surface for tuning screws and an access connector and coupling irises can be cut in the bases.

3 Claims, 2 Drawing Sheets

DIELECTRIC-LOADED CAVITY RESONATOR

FIELD OF THE INVENTION

Our present invention relates to devices for microwave telecommunications systems and, more particularly, to a dielectric-loaded cavity resonator.

BACKGROUND OF THE INVENTION

In telecommunications systems for civilian use there is a problem of providing microwave filters allowing the various transmission channels to be allocated in the desired frequency bands. Usually these filters are implemented with a plurality of cavity resonators mutually coupled through irises, screws or the like.

When such filters are to be used in transponders installed on board a satellite, the resonator size has to be as small as possible. In fact, since some ten filters could be used and each filter is generally composed of 4 to 8 resonators, the encumbrance is considerable. Namely, at a center frequency of 12 GHz, a 6pole filter implemented with dual-mode cylindrical cavities has, as a whole, a 30 mm diameter and a 60 mm length.

Recently it has been suggested to introduce a small dielectric cylinder into each cavity resonator to reduce the filter sizes. This has been rendered possible by the availability of high-permittivity, low-loss, high temperature-stability dielectric materials.

The high permittivity of the material introduced into the resonator ensures that the electromagnetic field will be practically completely concentrated inside it. That is why the cavity dimensions, calculated to obtain the resonance at a determined wavelength, are greatly reduced. Under the same conditions as those of the preceding example, the total dimensions of an equivalent filter with dielectric-loaded resonators decrease to about 20 mm for the diameter and 30 mm for the length, with an overall reduction to less than a fourth of the original volume.

One of the problems encountered in implementing a dielectric-loaded resonator of this kind is to conveniently support the small dielectric cylinder placed inside the resonator. In fact dielectric material cannot completely fill up the metallic cavity both because of the high loss increase due to the contact between metal and dielectric and of the necessity of inserting tuning screws into the lateral resonator surface. Hence, it is required to provide a supporting structure for the dielectric material, which is capable of holding it in the correct position without detriment to its electrical characteristics, by keeping losses low, and of assuring the necessary mechanical stability of the structure, chiefly for use on board a satellite.

The article entitled "Dielectric-Resonators Design Shrinks Satellite Filters and Resonators" by S. Jerry Fiedziuszko, in MSN & CT, August 1985, describes a cylindrical cavity resonator of the same type as those conventionally used in unloaded filters, into which an ultra-low-loss ceramic material cylinder is introduced. The small dielectric cylinder is held in correct position by a plastic material disk or by a more complex support made of silicon foam.

Yet this solution presents a number of inconvenience if the filter is to be used for processing signals even with moderate powers. In fact plastic material can tolerate moderate temperatures, usually lower that 100° C., and silica foam has extremely low thermal conductivity; that is why the heat produced in the dielectric cylinder is only partly dissipated.

In addition, by using a single supporting disk, as can be seen from FIG. 11 of the cited article, mechanical stability seems rather limited, unless adhesives are used between the disk and the small dielectric cylinder, which considerably increase losses.

Other solutions providing the use of supporting disks made of different materials, such as alumina or forsterite, are not considered satisfactory by the author of the above-mentioned article owing to their poor temperature stability.

OBJECT OF THE INVENTION

It is an object of the invention to overcome these drawbacks by an improved dielectric-loaded cavity resonator, which does not have particular limitations to operating temperatures and has considerable mechanical stability without the use of adhesives, thus affording a very high quality factor.

SUMMARY OF THE INVENTION

The present invention provides a dielectric-loaded cavity resonator, comprising a cylindrical metallic body housing a dielectric cylinder coaxial with the cavity, wherein the dielectric cylinder is held in place by two dielectric disks, each provided with an axial hole and a centering indentation housing a respective base of the dielectric cylinder.

BRIEF DESCRIPTION OF THE DRAWING

The foregoing and other characteristics of the present invention will be made clearer by the following description of a preferred embodiment of the invention, given by way of non-limiting example, and by the annexed drawing in which.

The cavity resonator described below has a cylindrical shape and consists of a suitably-shaped metallic part and of a pair of appropriately shaped supporting plates for a dielectric cylinder, such as to form as a whole a mechanically stable structure without the use of adhesives.

Figure 1:
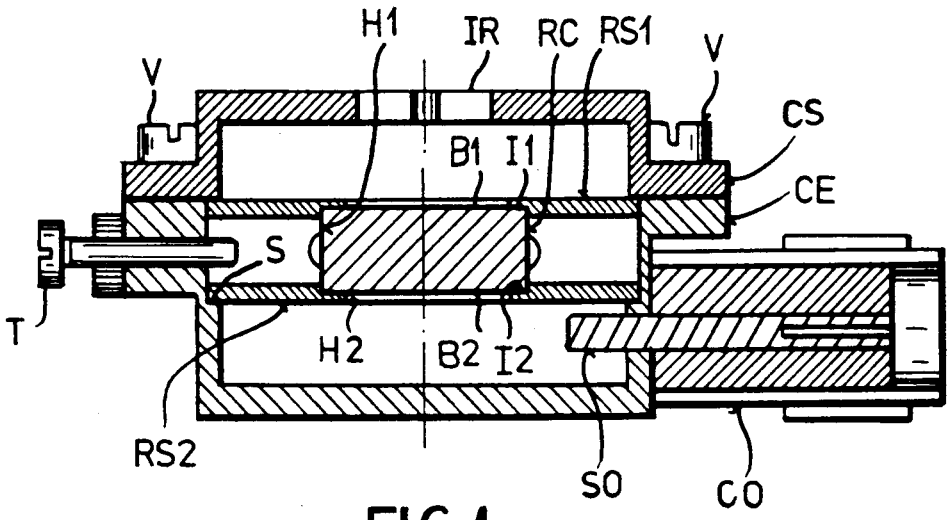
FIG. 1 is a longitudinal section of the resonator.

In FIG. 1 RC denotes the cylinder made of dielectric material, i.e. of ceramic, by which the cavity resonator is loaded. It is held in a position coaxial with the cylindrical cavity by two small plates RS1 and RS2 shaped as disks, each with an axial hole, H1, H2 useful to reduce losses, and with a centering indentation apt I1, I2 adapted to house one of the bases B1, B2 of the cylinder RC.

The metallic body of the cylindrical resonator is subdivided transversally to the axis into two parts CE, CS, each with a flange for the mutual fastening by screws V. The part denoted by CE houses the group of dielectric elements formed by disks RS1, RS2 and by dielectric cylinder RC.

This group is housed in part CE thanks to a slight increase of the inner cavity diameter and is kept at a suitable distance from the bottom by the steps, due to the diameter difference. The depth of the cavity portion with greater diameter is advantageously made equal to the height of the group of disks and dielectric cylinder. In this way it is enough to realize part CS with a diameter slightly smaller than that of the disks to tightly hold in place the group of dielectric elements.

Apart from the coaxiality condition between the dielectric cylinder and the cylindrical cavity, there are no further constraints in the position of the cylinder itself along the cavity axis, provided there is enough space for the insertion of a coaxial access connector CO, equipped with a coupling probe SO.

In the base of part CS there is cut a cruciform iris IR for the coupling with other possible resonators forming the filter. A similar iris can be also cut in the base of part CE whenever the resonator is used in an intermediate stage of the filter.

Along the lateral surface of CE, in correspondence with the intermediate zone between the discs, threaded holes are formed into which screws T can be housed for the cavity tuning.

Supporting disks RS1, RS2, by contrast with what has been known from the literature, are made of quartz. This material can offer consistent advantages with respect to the previously examined materials:

extremely-low dielectric losses ($tg\delta = 10^{-4}$ at 10 GHz);

better thermal conductivity than that of foamy materials, namely silica foam and plastics;

very high operating temperature.

These characteristics make the cavity resonator, provided by the invention, have low losses and particularly suited to handle high-power signals. That is due both to the fact that the amount of heat produced, proportional to losses, is low, and to the fact that the thermal conductivity of quartz, and hence the dissipation of heat produced, is among the best that can be obtained with dielectric materials.

Machining of quartz disks does not present any particular problems, since it can be carried out by using normal diamond tools or by abrasive lapping.

Figure 2:
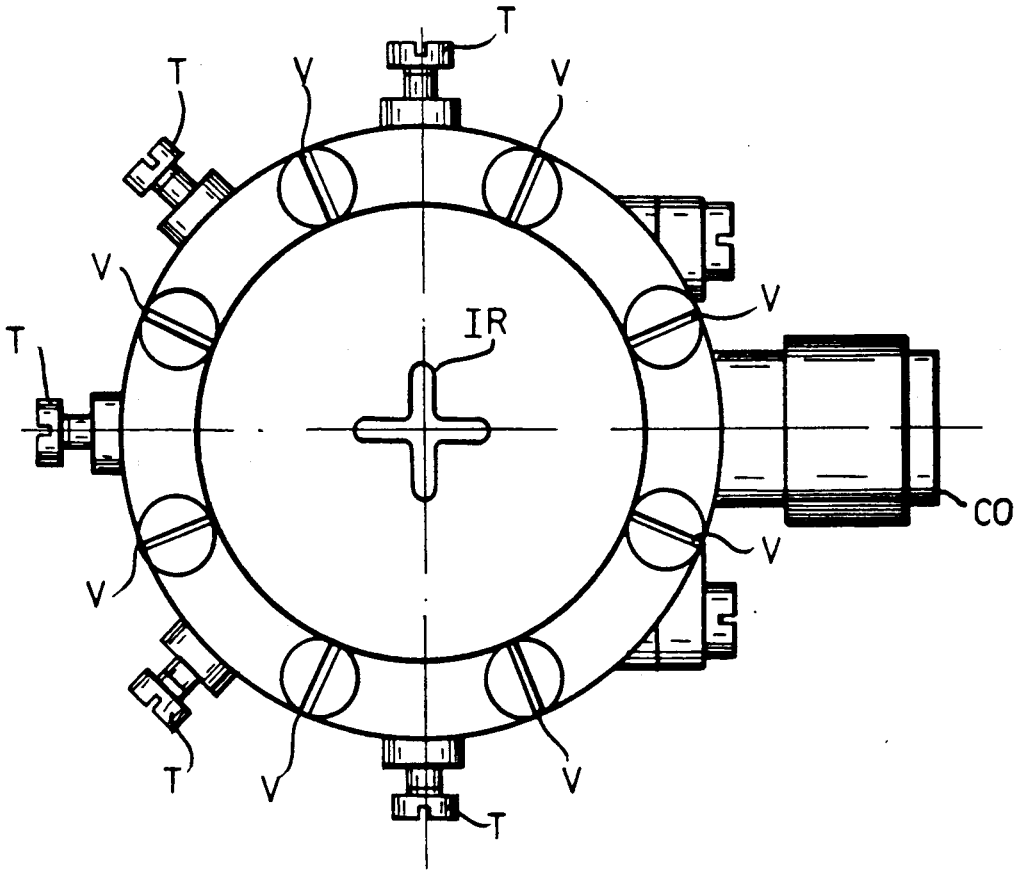
FIG. 2 is a view from top of the same resonator as in FIG 1.

FIG. 2 shows a view from top of the same resonator as in FIG. 1. In this coupling irises IS and tuning screws T can be more clearly seen.

Figure 3:
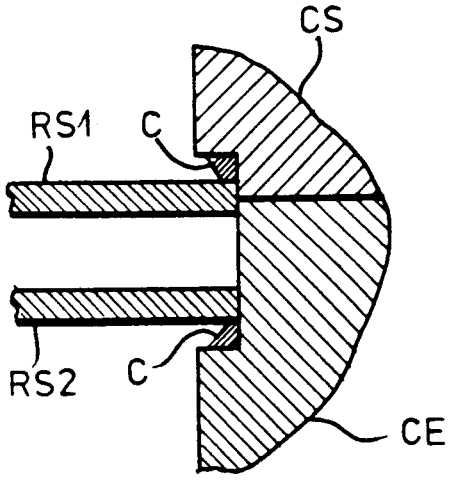
FIG. 3 is a detail section showing how the plates are held in place.

FIG. 3 shows a modification in which the assemblies of the plates RS1 and RS2 is held in the enlarged portion of the cavity by material C.

The cavity can have a square instead of a circular section. In this case, also RS1 and RS2 would have a square shape.

In addition, the axial hole of RS1 and RS2 could be left out to favour the dissipation of the heat produced in dielectric cylinder RC.

We claim:

1. A dielectric-loaded cavity resonator, comprising:

a generally closed metallic housing defining a cylindrical cavity and formed with two spaced-apart steps on opposite sides of an increased-diameter portion of said cavity spaced from opposite ends of said housing; and a dielectric assembly received in said housing and comprising:

a pair of dielectric plates each seated in one of said steps and formed with a centering indentation opening toward the other of said plates, and a dielectric cylinder received between said plates and having opposite bases each received in a respective one of said indentations, whereby said assembly formed by said plates and said cylinder is held in a fixed position in said cavity and is spaced from said ends by said steps.

2. The cavity resonator defined in claim 1 wherein said housing is subdivided transversely to an axis of said cavity into two parts, one of said parts being formed with said increased-diameter portion of a height substantially equal to the height of said assembly and the other of said parts being formed with a cylindrical cavity of a diameter slightly smaller than a diameter of said plates.

3. The cavity resonator defined in claim 1 wherein each of said plates is formed with an axial hole having a diameter smaller than that of said indentation.

* * * * *